US006543557B2

(12) United States Patent
Gien

(10) Patent No.: US 6,543,557 B2
(45) Date of Patent: Apr. 8, 2003

(54) DRILL HAMMER ASSEMBLY

(76) Inventor: Bernard Lionel Gien, Nos. 2 and 4, Simba Street, Edenville 161 Gauteng Province (ZA)

( * ) Notice: Subject to any disclaimer, the term of this patent is extended or adjusted under 35 U.S.C. 154(b) by 0 days.

(21) Appl. No.: 09/818,457

(22) Filed: Mar. 27, 2001

(65) Prior Publication Data

US 2002/0011360 A1 Jan. 31, 2002

(30) Foreign Application Priority Data

Mar. 27, 2000 (ZA) ..... 2000/1509

(51) Int. Cl.[7] ..... E21B 4/14

(52) U.S. Cl. ..... 175/296; 175/298; 175/321; 175/418

(58) Field of Search ..... 175/296, 298, 175/293, 321, 414, 418

(56) References Cited

U.S. PATENT DOCUMENTS 4,819,746 A * 4/1989 Brown et al. ..... 175/296
4,878,550 A * 11/1989 Chuang ..... 175/296
5,318,140 A * 6/1994 Ekwall et al. ..... 175/296

* cited by examiner

*Primary Examiner*—David Bagnell
*Assistant Examiner*—Zakiya Walker
(74) *Attorney, Agent, or Firm*—Lockenbach Siegel Harold Nissen Myron Greenspoon

(57) ABSTRACT

The invention concerns a down the hole drill hammer assembly providing a full piston area exposure to driving fluid pressure by the omission of the usual finger valve from the upper piston area and providing the piston with blind bores at each end and passages through the piston wall enabling predetermined communication between the blind bores for exhausting pressure fluid through the drill bit assembly. Fluid transfer passages are also provided in the inner wall of an outer wear sleeve of the drill hammer assembly.

7 Claims, 1 Drawing Sheet

DRILL HAMMER ASSEMBLY

FIELD OF THE INVENTION

This invention relates to a drill hammer assembly and more particularly to a drill hammer assembly for a down the hole rock drill.

BACKGROUND TO THE INVENTION

Down the hole rock drills are well known. Many drills of this kind have an air chamber above as well as below the piston. When the bottom chamber is pressurised with compressed air, the piston moves up and away from the bit. When the top chamber is pressurised the piston moves down towards the bit to strike the head of the bit. With each cycle, the chambers also have to exhaust. The bottom chamber does so by opening of the foot valve tube. The foot valve tube protrudes from the bit head here it engages in the bore of the piston. The exhaust air flows via the bore of the foot valve tube when it is open through the body of the bit and out to the atmosphere.

When the piston is in the upward stroke, there is a finger valve, which projects from the top chamber into the central bore of the piston to seal off the bore. When the piston moves towards the bit, the finger valve disengages from the bore of the piston and the top chamber exhausts through the central bore of the piston and then through the bore of the bit to the atmosphere.

All these constructions involve a reduction in the area of the piston exposed to working fluid due to the finger valve necessarily engaging in the piston bore.

It is advantageous to keep the overall diameter of the piston in a down-the-hole drill hammer assembly as small as possible while still operating an adequate piston area exposed to working fluid.

OBJECT OF THE INVENTION

Accordingly it is the object of the present invention to provide a drill hammer assembly of the kind referred to in which reduction of piston area exposed to the working fluid by the finger valve is avoided.

SUMMARY OF THE INVENTION

According to this invention there is provided a down the hole drill hammer assembly comprising a backhead fitted into a wear sleeve, a piston forming the hammer reciprocable in the wear sleeve and a drill bit assembly including a foot valve tube and an anvil of smaller surface area than the hammer end of the piston located in the end of the wear sleeve remote from the backhead characterised in that the piston has blind bores extending from each end and ports through the wall of the piston providing for communication between the blind bores, a collar around the piston and the piston having a diameter at the hammer end larger than the backhead end, the backhead including an axial inlet passage and branched outlet passages through the wall of the backhead, longitudinal passages in the inner wall of the wear sleeve to provide selectively flow paths from the inlet to the upwardly exposed surfaces of the piston or alternatively to the upper surface of the collar and the drill bit end of the piston around the anvil with exhaust passages through the piston and communicating externally of the piston between the blind bores in the piston.

Further features of this invention provide a check valve located in the inlet passage.

The invention also provides for the bit assembly to be fitted in conventional manner to be axially movable in sealing engagement with the bottom end of the wear sleeve.

BRIEF DESCRIPTION OF THE DRAWINGS

These and other features of this invention will become apparent from the following description of one preferred embodiment described below with reference to the accompanying drawing.

In the drawing.

DETAILED DESCRIPTION WITH REFERENCE TO THE DRAWINGS

Figure 1:
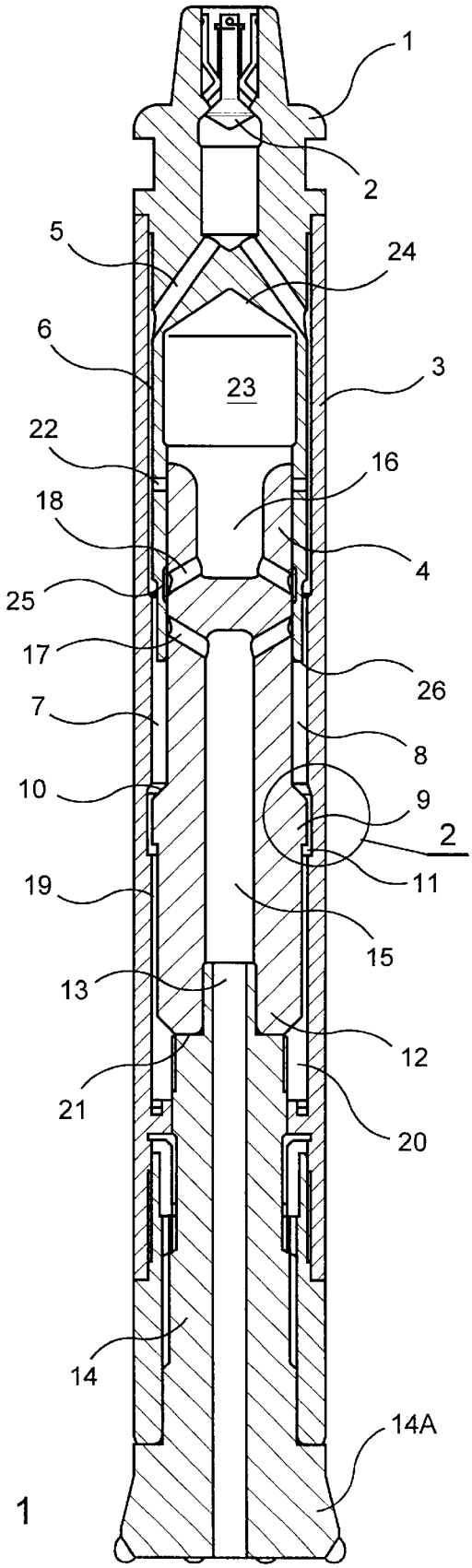
FIG. 1 shows a longitudinal cross-section of down-the-hole drill assembly.
Figure 2:
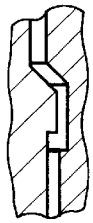
FIG. 2 shows an enlarged detail of FIG. 1 defined by the circle with the reference numeral 2.

As shown the drill assembly consists of a backhead (1) with an axial inlet passage controlled by a check valve (2). The backhead fits into a wear sleeve (3) forming a cylinder within which a piston (4) can reciprocate. Entry ports (5) extend through the wall of the backhead (1) and open into longitudinal passages (6) in the wall of the wear sleeve (3).

The passages (6) open at their operatively lower ends into an annular chamber (7) around the piston (4). The lower end of chamber (7) is enlarged at (8) and accommodates a collar (9) on the piston (4).

The bottom end (12) of the piston (4) provides the hammer face and a foot valve tube (13) extends from a drill bit assembly (14) into a blind bore (15) in the piston (4) in one direction and through the drill bit (14A) at the other.

The drill bit assembly (14) is mounted in the bottom of the wear sleeve in a conventional manner which maintains the bit in sealing engagement with the wall of the wear sleeve and provides limited relative axial movement between the bit assembly and wear sleeve.

There is a second blind bore (16) in the upper end of the piston (4) and ports (17) and (18) through the walls of the blind bores (15) and (16) respectively. These open in close proximity to each other on either side of a bridge separating the bores (15) and (16).

The passages (6) extend downwardly from the chamber (7) as passages (19) between the hammer end of the piston (4) and the wall of the wear sleeve (3). These passages terminate in chamber (20) where fluid pressure can act on the inclined outer surface of the end of the piston (4) around the anvil end of the bit.

The drill bit assembly (14) provides around the foot valve tube (13) an annular anvil (21) for the piston (4).

Ports (22) are provided so that passage (6) can communicate with a chamber 23) formed between the upper end of the piston (4) and the internal wall (24) of the backhead (1).

It should be noted that with the above construction the chamber (7) is at all times during operation of the hammer in fluid communication with the inlet through check valve (2) and passages (6).

Further it will be seen that the ports (22) can be closed or opened by movement of the piston (4) within the wear sleeve. Similarly the collar (9) on the piston can selectively open or close the flow path from the chamber (7) through the enlargement (8).

In use compressed air enters the backhead (1) and opens the check valve (2) permitting flow through ports (5). The air then enters the passages (6) and flows into chamber (7).

Chamber (7) is always full of compressed air from the supply. The air then flows past collar (9) on the piston (4) via enlargement (8) in the wear sleeve and into the bottom chamber (20). The compressed air acts on the bottom annular surface of the piston and lifts the piston away from the drill bit assembly (14) in its upward stroke. In this part of the stroke the collar (9) on the piston closes the bottom end of chamber (7) in the wear sleeve and shuts the flow of the compressed air to chamber (20). The compressed air in chamber (20) keeps expanding until the hammer end (12) of the piston passes the end of the foot valve tube (13). The air in chamber (20) then exhausts down the bore (13) of the bit and out to the atmosphere.

The piston (4) continues in its upward travel until ports (18) line up with ports (22). The compressed air from ports (5) and passage (6) enters the top chamber (16) and acts on the surface area of the whole upper blind bore (16).

The surface areas of blind bore (16) and upper surface (10) of collar (9) combine to make up the full surface area of the bore of the wear sleeve without a loss of the surface area of the bore in the piston, as in conventional hammers. Surface (10) is always under pressure since chamber (7) does not exhaust during the cycle.

The piston (4) now starts the movement towards the bit in its power stroke.

The piston shuts ports (22) and the air acting on surface of blind bore (16) keeps expanding, and in conjunction with the air acting on surface (10), accelerates the piston to strike the annular anvil (21). In the downward movement of the piston ports (18) open in the passage (25) formed in the backhead. Passage (25) enables ports (17) and (18) to communicate and the exhaust air from the top chamber (16) flows via ports (18) into passage (25) and into ports (17). The exhaust air then flows down the piston bore (15) and the foot valve tube (13) in the bit to the atmosphere.

When the hammer is lifted off the bottom of the borehole in a "flush only" mode, the bit drops forward against the bit retaining rings in conventional manner. The piston (4) follows the bit and ports (17) move past of the inner end of the back head (1) and compressed air flows from chamber (7), which is always exposed to air, via ports (17) into the bore (15) of the piston through the bit and out to the atmosphere. At the same time the lower end (11) of the collar (9) on the piston shuts off passage (19) in the bore of the wear sleeve to prevent airflow reaching chamber (20). At the same time the upper end of the piston opens ports (22) and the top chamber (16) is supplied with compressed air. Air pressure acting on piston surface area (16) and (10), and the absence of pressure on surface area of the anvil (21) caused the piston to be inactive and only flushing takes place.

The dimensions of the various passages and chambers can readily be determined by those skilled in the art and the hammer drill provides optimum use of the piston surface during the power stroke.

What is claimed is:

1. A down the hole drill assembly comprising a backhead fitted into a wear sleeve, a piston forming a hammer reciprocable in the wear sleeve and a drill bit assembly including a foot valve tube and an anvil of smaller surface area than the hammer end of the piston located in the end of the wear sleeve remote from the backhead characterised in that the piston has blind bores extending from each end and ports through the wall of the piston providing for communication between the blind bores, a collar around the piston and the piston having a diameter at the hammer end larger than the backhead end, the backhead including an axial inlet passage and branched outlet passages through the wall of the backhead, longitudinal passages in the inner wall of the wear sleeve to provide selectively flow paths from the inlet to the upwardly exposed surfaces of the piston or alternatively to the upper surface of the collar and the drill bit end of the piston around the anvil with exhaust passages through the piston and communicating externally of the piston between the blind bores in the piston.

2. A down the hole drill assembly as claimed in claim 1 characterised in that a check valve is located in the inlet passage.

3. A down the hole drill assembly as claimed in claim 2 characterised in that the bit assembly is fitted in conventional manner to be axially movable in sealing engagement with the bottom end of the wear sleeve.

4. A down the hole drill assembly in which reduction of piston area exposed to working fluid is avoided comprising:

(a) a backhead fitted into a wear sleeve, (b) a piston forming a hammer reciprocable in the wear sleeve, (c) a drill bit assembly including a foot valve tube and an anvil of smaller surface area than the hammer end of the piston located in the end of the wear sleeve remote from the backhead, (d) said piston having blind bores extending from each end and ports through the wall of the piston providing for communication between the blind bores, (e) a collar around the piston and the piston having a diameter at the hammer end larger than the backhead end, (f) the backhead including an axial inlet passage and branched outlet passages through the wall of the backhead, and (g) longitudinal passages in the inner wall of the wear sleeve to provide selectively flow paths from the inlet to the upwardly exposed surfaces of the piston or alternatively to the upper surface of the collar and the drill bit end of the piston around the anvil with exhaust passages through the piston and communicating externally of the piston between the blind bores in the piston.

5. The down the hole drill assembly as claimed in claim 4, free of a finger valve extending into the hammer end, and said hammer end being larger than the backhead end thereby to use the whole upper surface of the hammer for generating the striking force.

6. The down the hole drill assembly as claimed in claim 4 wherein the bit assembly is fitted in conventional manner to be axially movable in sealing engagement with the bottom end of the wear sleeve.

7. The down hole drill assembly as claimed in claim 4 wherein the surface areas of the blind bore and the upper surface of the collar cooperate to make up the full surface area of the bore of the wear sleeve without a loss of the surface area of the bore in the piston.

* * * * *